United States Patent [19]

Ptaszek et al.

[11] 4,288,943

[45] Sep. 15, 1981

[54] SIMULATED FIRING AND SIGHTING SYSTEM

[76] Inventors: George W. Ptaszek, P.O. Box 260, Pascoag, R.I. 02859; Robert H. Hudson, 103 Valley St., Seekonk, Mass. 02771

[21] Appl. No.: 100,487

[22] Filed: Dec. 5, 1979

[51] Int. Cl.[3] ..... A63H 27/00

[52] U.S. Cl. ..... 46/227; 46/1 B; 46/1 H; 46/228; 273/316

[58] Field of Search ..... 273/351, 313, 316; 46/226, 227, 228, 1 B, 1 H; 35/12 N; 124/80, 83

[56] References Cited

U.S. PATENT DOCUMENTS

| | | | |
|---|---|---|---|
| 2,864,613 | 12/1958 | Porter | 46/1 B |
| 3,010,718 | 11/1961 | Pearson, Jr. | 46/1 B |
| 3,441,270 | 4/1969 | Nielsen | 272/8 M |
| 3,608,234 | 9/1971 | Davidson | 46/1 B X |
| 3,635,477 | 1/1972 | Ochi | 273/316 |
| 3,693,281 | 9/1972 | Wolf | 46/228 |

FOREIGN PATENT DOCUMENTS

| | | | |
|---|---|---|---|
| 466181 | 10/1928 | Fed. Rep. of Germany | 273/313 |
| 1097040 | 6/1955 | France | 273/351 |
| 316792 | 12/1956 | Switzerland | 273/351 |

*Primary Examiner*—Richard C. Pinkham
*Assistant Examiner*—Scott L. Brown
*Attorney, Agent, or Firm*—Barlow & Barlow

[57] ABSTRACT

A simulated laser firing target sighting and missile firing and tracking system is incorporated in a hand-held simulated jet fighter plane model. The operator views by looking vertically downwardly a centrally oriented target sighting control screen that depicts the spatial region immediately in front of the jet fighter model plane. The model plane is further equipped with two stub wing mounted firing control handles serving as the operator control means and being mounted on either side of the plane's control panel. Operator finger pressure exerted on the left side control handle firing button results in a visual display of a clearly visible white lighted inverted V-shaped image pattern along with a central white illuminated circle simulating a laser beam being fired at an imaginary target located within a central target circle scribed on the ground glass screen. The right side hand control firing button is then pressed by the operator resulting in a visual display on the said control screen of a red light located in the centrally disposed control screen target circle. This red light display indicates in the mind of the operator a successful hit by the just fired laser missile. A jet fighter plane operator control panel is also provided facing the operator pilot while holding the model along with the forward segment of a jet fighter fuselage with its bottom mounted telescopic focus control and stub wing structure that together comprises the main physical structure of the present invention.

5 Claims, 3 Drawing Figures

SIMULATED FIRING AND SIGHTING SYSTEM

BACKGROUND OF THE INVENTION

This invention relates to hobby models in general.

This invention relates more particularly to hobby models wherein a photo optical system can be positioned at a strategic location in a completed model. This invention also relates to a visual target sighting apparatus.

This invention relates more particularly to a visual sighting device for achieving simulated target viewing and simulated laser missile firing capacity in connection with a simulated jet fighter carrying missiles.

This invention also relates to a jet fighter instrument control and target sighting panel, and more particularly to an improved photo optically illuminated simulated instrument control panel for use in a simulated jet fighter model.

This invention also relates more particularly to a model jet fighter plane system incorporating the simulated laser missile firing system in a telescopic focusing control system.

Prior art devices utilizing a telescopic device for a toy gun are known. See, for example, U.S. Pat. No. 3,441,270. This system however, utilizes two mirrors and does not employ a ground glass for image derivation, as in the present invention.

SUMMARY OF THE INVENTION

It is therefore an object of the present invention to provide a hobby model capable of providing a substantially real-life reproduction of a jet figher model interior and exterior. It is a further object of the present invention to provide a hobby model incorporating a photo optical system that can be positioned at a strategic location in the completed model.

It is still another object of the present invention to provide a visual target sighting apparatus.

It is yet a further object of the present invention to provide a visual sighting device for achieving simulated target viewing and laser missile firing capacity in connection with a simulated jet fighter carrying missiles.

It is still yet another object of the present invention to provide a jet fighter instrument control and target sighting panel, and more particularly to provide an improved photo optically illuminated simulated instrument control panel for use in a jet fighter model.

In accordance with the present invention, there is provided a simulated laser fighter target sighting and missile firing and tracking system that is incorporated in a simulated jet fighter model. The pilot operator views in a generally vertical downward direction a centrally disposed target sighting control screen that consists of a manually adjusted telescopically focused generally horizontal ground glass screen, projection being an optically derived right-sided image that depicts the spatial region directly in front of the jet fighter model plane. The model plane is further equipped with two stub wings having mounted thereon firing control handles, serving as the simulated laser firing control means, one being mounted on either side of the plane's control panel on the said stub wing extensions of the plane's fuselage structure. The operator's finger pressure on the left side control handle firing button results in the visual display of a clearly visible white light inverted V-shaped image pattern along with a central illuminated white circle. These displays simulating a laser missile being fired at an imaginary target located within a central target circle scribed on the ground glass control screen. Simultaneously, upon pressing the left side control handle firing button, an audible buzzer alarm signal is generated indicating that a laser is being fired and has hit its target. The right side control handle firing button is then depressed by the operator resulting in a further visual display on the said ground glass control screen of a red light located in the centrally disposed central screen target circle area. This red light display indicates a successful hit and subsequent fire caused by the previously fired laser beam. A jet fighter plane simulated operator control panel is also provided facing the operator while holding the model along with the forward segment of a jet fighter fuselage with its bottom mounted telescopic focus control and stub wing structure that together comprises the main physical structure of the present invention.

This disclosure relates to a model which consists generally of pre-molded parts, such as plastic or the like, which are precision assembled, pre-assembled in a well known manner to provide a resulting scale model of considerable accuracy and detail of the external parts of the original structure being copied.

The above objects and still further objects of the present invention will immediately become apparent to those skilled in the art as the consideration of the following preferred embodiment of the present invention thereof, which is provided by way of example, and not by way of limitation.

Further, the various points of novelty which characterize this invention are pointed out with particularity in the claims annexed to and forming an inherent part of this specification.

DESCRIPTION OF THE PREFERRED EMBODIMENT

Figure 1:
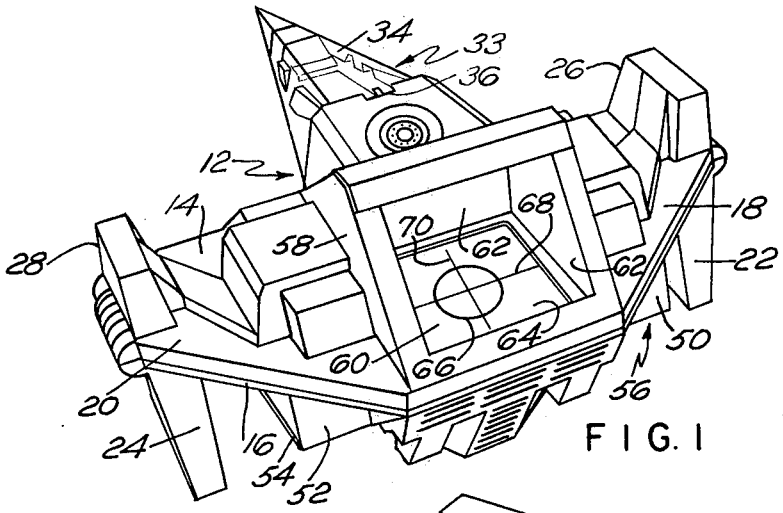
FIG. 1 is a rear perspective view of an illustrative embodiment of the present invention.

Referring now generally to the figures, and in particular to FIG. 1, there is shown an assembled model laser firing jet fighter system of the present invention. The major components depicted are the jet fighter fuselage 12 comprised of a fuselage top half 14 and a fuselage buttom half 16. Extending outwardly from the rearmost portions of the side portions of the fuselage 12 are right stub wing 18 and left stub wing 20 respectively. These right and left stub wings 18 and 20 respectively terminate outwardly in manual right control handle 22 and left control handle 24 respectively. The control handles 22 and 24 are essentially rectangular elongated structures that are specifically designed for the convenience of an operator to control the handling of the present invention. Situated at about the mid point of the forward facing outer surfaces 26 and 28 of control handles 22 and 24, respectively, are simulated fire control buttons 30 and 32 respectively.

Occupying a major forward portion of the fuselage 12 is a top mounted fighter pilot compartment 33. The upper surface of pilot compartment 33 is formed by a clear pilot compartment cover 34 that raises upwardly and rearwardly on a compartment hinge 36. A pilot seat 38 is provided covering most of the lower floor of the pilot compartment 33. A pilot figure (not shown) would occupy this pilot compartment 33 when desired.

Figure 2:
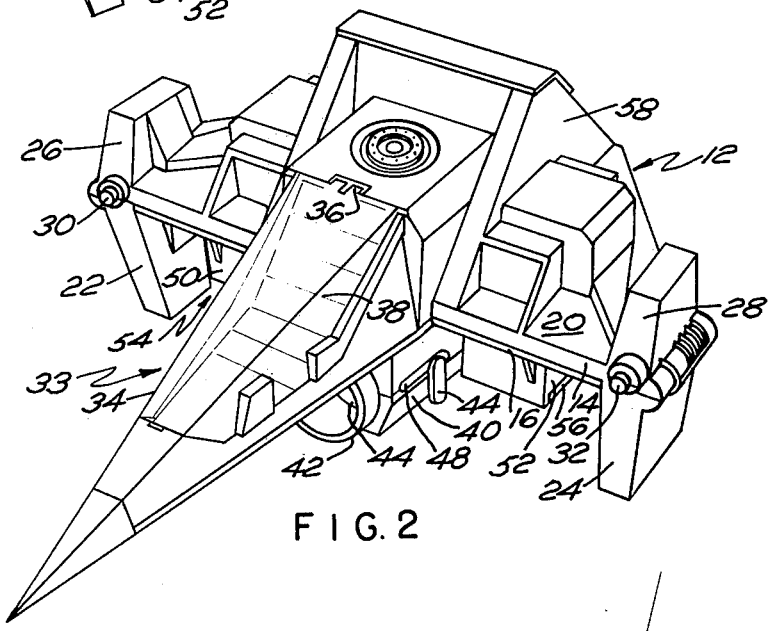
FIG. 2 is a front perspective view of an illustrative embodiment of the present invention.

Referring now to FIG. 2 which is a front elevational perspective view of an illustrative embodiment of the model of the present invention, there is mounted to the central region of the fuselage bottom half 16 a telescopic lens housing 40. This irregularly-shaped lens housing 40 serves to slidably mount a cylindrically-shaped elongated lens tube 42. Situated fixably at the rear end of slidably disposed lens tube 42 is a bi-convex circular lens 44. Movement forward and rearward of bi-convex lens 44 is accomplished by an operator manually controlled sliding movement of the lens tube 42 co-planar to the fuselage through a gripping and sliding of the attached lens knobs 44', which are affixed to the outer periphery of lens tube 42. Lens tube housing grooves 48, located on both sides of the lens housing 40, serve to both align and limit the sliding movement of lens tube 42.

Mounted to the under surface of stub wings 18 and 20 are rectangularly-shaped battery compartments 50 and 52, respectively. Battery compartments 50 and 52 are both fitted with sliding access doors 54 and 56 respectively, which allows battery (not shown) replacement whenever necessary.

Located at the rear section occupied by the fuselage top half 14 is a wedge-shaped control panel (FIG. 1) and control screen housing 58. A square shaped sloping opening 60 is provided for pilot operator visibility into the interior of this housing 58. Within the control housing 58 and lining its three vertical walls is a simulated jet plane control panel apparatus 62. The base of this wedge-shaped control housing 58 is occupied by a square shaped ground glass control screen 64.

Figure 3:
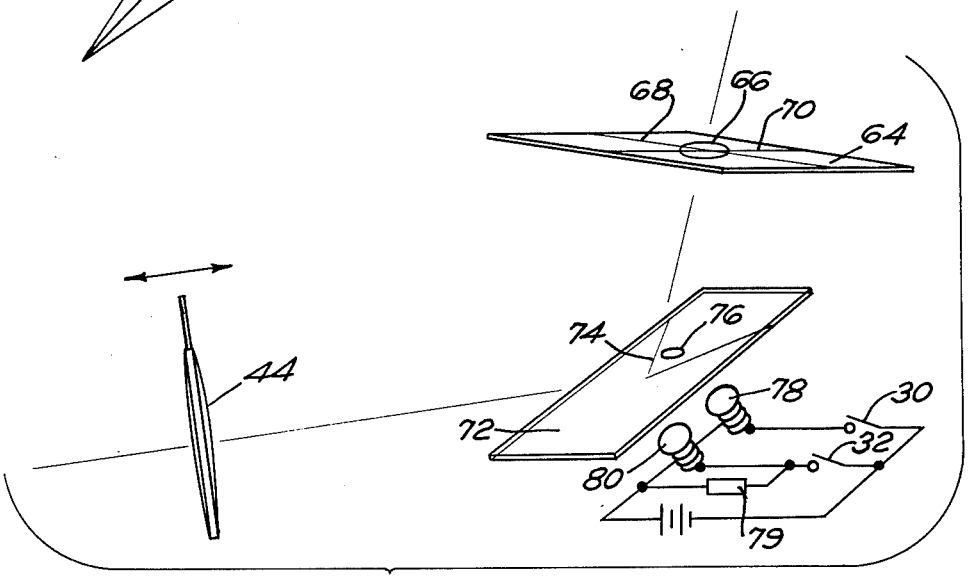
FIG. 3 is an exploded photo optical and electrical component view of the telescopic focusing control system of the present invention.

FIG. 3 is a partial exploded photo optical component view of the telescopic focusing control system of the present invention. Scribed upon the top surface of the ground glass control screen 64 are lines marking a centrally disposed target circle 66 and horizontal and vertical cross lines 68 and 70 respectively. Situated below the ground glass screen 64 and located in the fuselage bottom half 16 is a rectangularly-shaped silver mirror 72 that is disposed at a 45° angle to both the bi-convex lens 44 and the ground glass screen 64. Scribed onto the silver surface of mirror 72 is a V-shaped missile projectory marking 74 and a circular target spot 76. Located below the underside of mirror 72 are two light sources, red light source 78 and white light source 80. Also located in this general region of the fuselage bottom 16 is an alarm buzzer 79.

During the typical operational sequence of the present invention, the operator holds the model in both hands by securely grasping the right control handle 22 and the left control handle 24 with the right and left hands respectively. Looking down generally vertically onto the upper surface of the ground glass control screen 64 through opening 60, the operator manually directs the fighter fuselage 12 into a desired direction in order to locate and aim the target view. The ground glass image will most likely be out of focus initially, and precise focusing of the target image on the ground glass control screen 64 is accomplished by manually sliding the telescopic lens tube 42 in housing channel both forward and rearward until the ground glass image is in sharp focus on the control screen 64.

The operator now moves the model slowly to obtain a final cross hair locking-on of the target by the use of both cross hair 68 and 70, and the centrally disposed engraved target circle 66. When the target is visually aligned as described above, the operator next presses the left control handle mounted fire control button 32. Upon pressing the fire control button 32, the ground glass control screen 64 visually displays a clearly visible white light illuminated inverted V-shaped image pattern, along with a centrally disposed white illuminated circle which is preferably diffused, the spot 76 having a ground surface on the glass mirror 72. These illuminated white light displays are formed by the sudden illumination provided from the energizing of white light bulb 80 in combination with the transparent scribed V-shaped pattern 74 and the circular dot pattern 76 that are located on the surface of silver mirror 72.

This illuminated white light display depicts in the operator's mind a simulated laser firing with an attendant impact on the prescribed target.

Simultaneously upon the pressing of the fire control button 32, an audible buzzer alarm signal is generated by the alarm buzzer 79 incorporated within the fighter fuselage 12. This alarm sound indicates in the operator's mind that the laser missile has been successfully launched and has contacted its target. The operator at this time then presses the right control handle mounted via control button 30. Upon pressing the blast control button 30, the ground glass control screen 64 displays a clearly visibly illuminated red flash located within the central target circle 66. This illuminated red signal indicates in the operator's mind an explosion of the enemy target with its subsequent destruction. This illuminated red light display is due to the sudden illumination provided from the energizing of red light bulb 78, in combination with the transparent circular dot pattern 76 located on the surface of silver mirror 72.

Obviously the light and sound sequences may be in accordance with any scheme appropriate to the vehicle for which the firing system is intended, and the outline of the assembly may be of any desired size and shape.

While the specific preferred embodiment of an improved model laser fighter system has been disclosed in the foregoing description, it will be understood that various modifications within the spirit of the invention may occur to those skilled in the art. Therefore, it is intended that no limitations be placed upon the invention except as defined by the scope of the appended claims.

What is claimed is:

1. A hobby model simulated aircraft vehicle comprising a fighter fuselage having stub wings incorporating manual handles, one at either side of said fuselage;

optical focusing means having an axis generally below and generally parallel to the longitudinal extent of the fuselage;

a simulated cockpit having a screen generally parallel to the longitudinal extent of the fuselage above the optical axis of said focusing means to be viewed at right angles thereto from above and having target locating means to transfer a target viewed along the axis of said focusing means at generally right angles thereto onto said screen to be viewed vertically from above;

manual means to light said screen to simulate laser firing when the target is desirably focused on the screen by manipulation of said manual handles.

2. A toy as in claim 1 with an additional independent manual means to red light said screen to simulate an explosion of the target.

3. A toy as in claim 2, with means to sound a noise of said explosion.

4. A toy as in claim 1 with said telescopic focusing means comprising a telescoping casing in at least two parts, a lens carried by one part thereof and means to move the part carrying said lens relative to another part of the casing.

5. A toy as in claim 1 wherein said screen is ground glass.

* * * * *